US005169238A

United States Patent [19]

Schenk

[11] Patent Number: 5,169,238

[45] Date of Patent: Dec. 8, 1992

[54] TAKE APART LOCK

[75] Inventor: Ronald G. Schenk, Kitchener, Canada

[73] Assignee: Waterloo Furniture Components Limited, Ontario, Canada

[21] Appl. No.: 739,217

[22] Filed: Aug. 1, 1991

[30] Foreign Application Priority Data

Jun. 10, 1991 [CA] Canada ..... 2044203

[51] Int. Cl.[5] ..... F16C 29/10; A47B 88/04

[52] U.S. Cl. ..... 384/21; 312/333

[58] Field of Search ..... 384/18-22, 384/49, 50, 51; 312/348, 333

[56] References Cited

U.S. PATENT DOCUMENTS

| | | | |
|---|---|---|---|
| 3,258,299 | 6/1966 | Meyer | 384/18 |
| 4,065,196 | 12/1977 | Stein | 312/333 |
| 4,274,689 | 6/1981 | Vander Ley et al. | 312/333 |
| 4,469,384 | 9/1984 | Fler et al. | 312/333 |
| 4,473,262 | 9/1984 | Staye | 312/333 |
| 4,749,242 | 6/1988 | Rechberg | 312/333 |
| 4,872,734 | 10/1989 | Rechberg | 312/333 |
| 5,002,402 | 3/1991 | Parvin | 384/21 |

FOREIGN PATENT DOCUMENTS

| | | |
|---|---|---|
| 81160 | 6/1903 | Canada . |
| 421924 | 8/1944 | Canada . |
| 1170702 | 7/1984 | Canada . |
| 1173095 | 8/1984 | Canada . |
| 1188357 | 6/1985 | Canada . |
| 2007326 | 7/1990 | Canada . |

*Primary Examiner*—Thomas R. Hannon

*Attorney, Agent, or Firm*—Hoffman, Wasson & Gitler

[57] ABSTRACT

A unique take-apart lock mechanism for use with drawer slides in cabinet and drawer arrangements is disclosed. The mechanism comprises a release lever, a butterfly catch and a pair of stop blocks. The butterfly catch and release lever are mounted within the drawer slide and the stop blocks mounted within the larger cabinet slide. By moving the release lever slideably within the inner channel, a pair of projections pull outwardly biased resilient wings of the butterfly catch inwardly, therefore allowing them to pass by the stop blocks, enabling the drawer to be removed from the cabinet. When the release lever is returned to its normal position, the drawer can be extended from the cabinet outwardly to a locked position thereby prohibiting it from being removed or accidentally falling.

7 Claims, 4 Drawing Sheets

TAKE APART LOCK

FIELD OF INVENTION

This invention relates to drawer slides and more particularly drawer slides wherein the drawer is capable of being locked within the cabinet in an extended open position thereby prohibiting removal and thereafter, unlocked to allow complete removal of the drawer from the cabinet.

BACKGROUND

It is well known in the art to provide for drawer slides comprised of two channels with a ball bearing retainer housing balls to reduce friction which is positioned between the outer and inner channel. Normally the larger channel is affixed to the cabinet sidewalls and the inner channel is affixed to the drawer. Both channels have generally curved side flanges extending substantially at right angles from the web.

Often such slide assemblies are used in filing cabinets in order to support heavy loads in the drawers. It is therefore necessary to provide a stop so that the drawer is not accidentally pulled from the file cabinet.

From time to time however, it is necessary to completely remove the drawer from the cabinet, for cleaning purposes or other reasons. Because of this, various locking/release mechanisms have been employed. Generally these consist of a projection extending from one slide and a pivoting lever being attached to the other. By finger movement the lever is moved from a normal locked position to a second position out of register with the stop, thereby permitting the drawer to be removed from the cabinet.

It has been found however, that such mechanisms are not fool-proof and are often complicated. Many of the lock and release mechanisms presently found in the art are not able to withstand the constant opening and closing of the file cabinets which is normal in today's business world. Moreover, such mechanisms have been found to be costly to produce and complicated to assemble.

It is, therefore, an object of the present invention to provide a drawer slide release and lock mechanism which is efficient, long-wearing and inexpensive to produce.

Moreover, it is an object of the present invention to produce a release/lock mechanism which can readily fit within the webs of the outer and inner channel of a normal two-channel drawer slide.

SUMMARY OF THE INVENTION

Therefore, this invention seeks to provide a lockable/releasable drawer slide assembly for use with a cabinet and drawers comprising: an outer slide channel adapted to be secured to a cabinet wall; an inner slide channel adapted to be secured to a drawer; a ball retainer and a plurality of ball bearings disposed between said outer slide channel and said inner slide channel; a releasable locking means adapted to either prevent said drawer from being withdrawn from said cabinet when in a first position, or to allow said drawer slide assembly to be separated, and said drawer to be removed from said cabinet, in a second position; said releasable locking means comprising a release lever, a butterfly catch including a pair of outwardly biased wings and a stop block; wherein in operation when said releasable/locking means is in said first position, said wings of said butterfly catch abut said stop block and when said locking means is in said second position said wings are retracted inwardly, free from contact with said stop block.

The present invention consists of three parts which are easily constructed from suitable materials. They consist of a release lever, a winged butterfly catch and a pair of projecting stop blocks. The stop blocks are mounted into the end of the large outer channel which is affixed to the cabinet. Both the butterfly catch and the release lever are mounted between the flanges on the web of the smaller channel. The release lever is slideably mounted within the channel whereas the butterfly catch is fixed.

The butterfly catch has a pair of diagonally extending and outwardly resiliently biased wings attached to a fixed non-flexible portion. These wings are equipped with grooves. In the normal locked position the wing tips are biased outwardly and substantially in contact with the flanges of the inner slide.

The release lever is equipped with a pair of projections at one end which are adapted to fit in a locked position within an aperture of the butterfly catch. In the locked position, the wing tips abut against the spaced apart stop block projections. When in operation, the release lever is moved longitudinally along the web of the smaller slide away from the butterfly catch, the two projections extend into and along the grooves in the wings, thereby exerting force on the wings and pulling them inwardly towards the center of the web.

When it is desirable to remove the drawer from the cabinet the release lever is moved along the web away from the butterfly catch and the projections on the release lever which extend along and within the grooves of the wings, pull the wings inwardly and thereby bring the wing tips out of contact with the pair of stop blocks and thus permit the entire drawer slide with the butterfly catch and the release lever therein, along with the drawer, to be removed from the cabinet.

BRIEF DESCRIPTION OF THE DRAWINGS

The invention is more clearly described in conjunction with a preferred embodiment wherein.

DETAILED DESCRIPTION OF THE INVENTION

Figure 1:
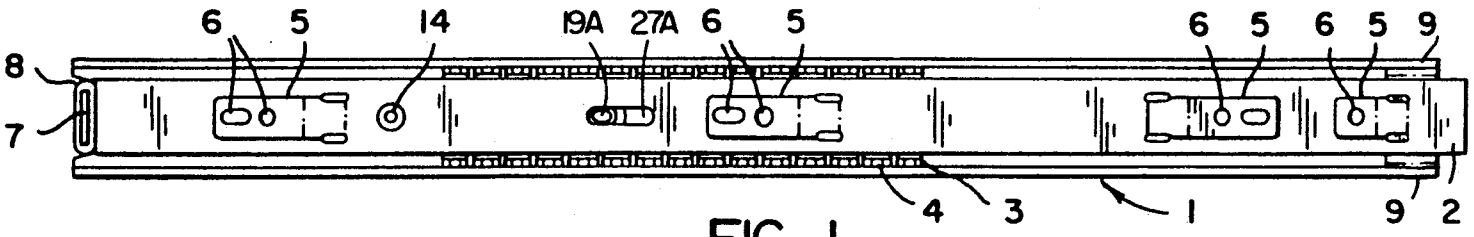
FIG. 1 is a side view of a drawer slide assembly in the closed position viewed from the drawer side.

In FIG. 1, a large outer channel cabinet slide 1 has slidingly engaged within it a smaller drawer slide 2. To enable the drawer slide to slide within the cabinet slide, a ball bearing retainer 3, having a plurality of balls 4, is positioned between side flanges of the two channels. Drawer slide 2 is equipped with a number of flange tabs 5 having apertures 6 therein to enable the slide to be mounted on the drawer. Drawer slide 2 is prevented from moving to the left (or rear) of cabinet slide 1 by an upturned flange 7 located on large cabinet slide 1. A rubber bumper 8 is fitted on flange 7. Large channel 1 has side flanges 9 bent upwardly at substantially right angles to the web of the channel slide. In FIG. 1 there is a longitudinal aperture 27A on the web of the drawer slide 2.

Figure 2:
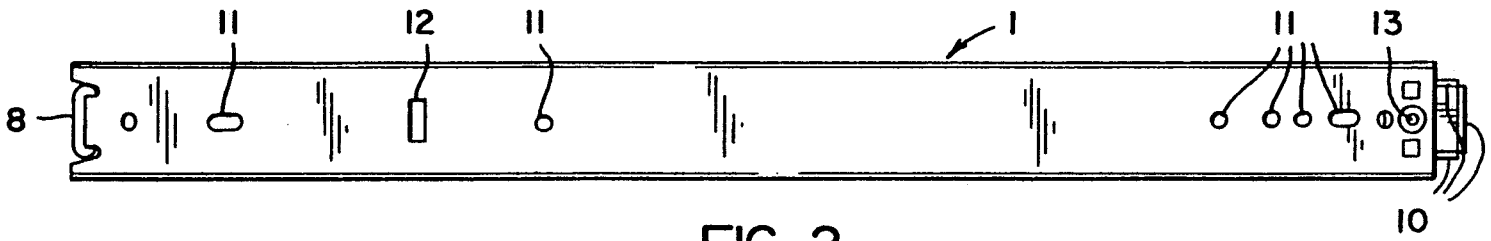
FIG. 2 is a similar view of a drawer slide assembly viewed from the cabinet side.

In FIG. 2, one notes that the inner channel 2 has upturned end and side flanges 10 which are bent at substantially right angles to the web, and therefore, 180° from those flanges 9 of large channel 1 such that the side flanges 9, 10 are substantially parallel to one another. Large channel 1 is also equipped with a number of apertures 11 which allow the channel slide 1 to be secured to the sidewalls of a cabinet. A tab 12 is turned inwardly from the web of large channel 1 in order to act as a stop for ball retainer 3. A rivet 13 secures a stop block within one end of the cabinet channel 1.

Figure 3:
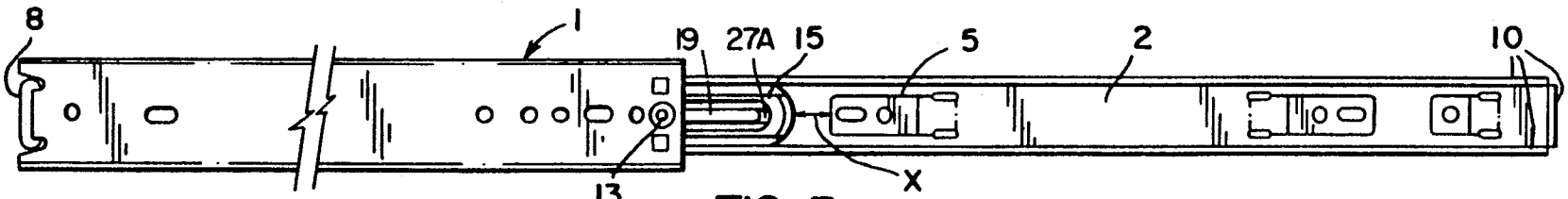
FIG. 3 is a side view of an extended drawer slide assembly viewed from the cabinet side in the locked position.

In FIG. 3, the drawer channel 2 has been extended outwardly of the cabinet channel 1, partially exposing a release lever 15, which is a part of the lock/release mechanism. One notes the distance "X" between the flange 5 and release lever 15.

Figure 4:
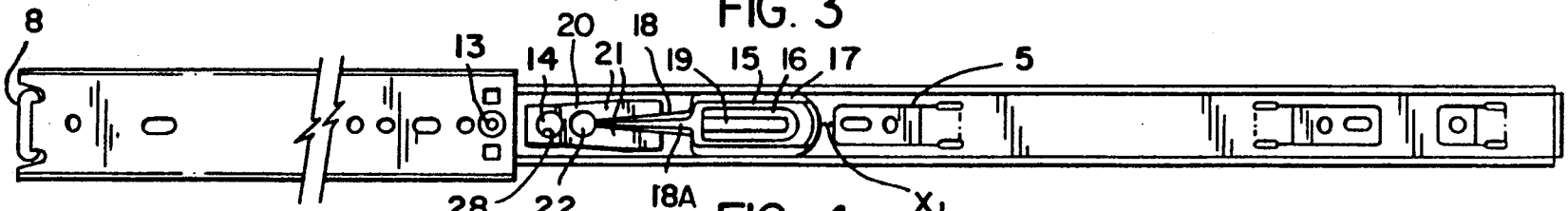
FIG. 4 is a side view of an extended drawer slide assembly in the unlocked position within the cabinet slide.

In FIG. 4, release lever 15 has been moved within the web of channel 2 towards tab 5 and is therefore, closer to the same at a distance of "Xl". One also notes that the release lever 15 has an elongated spring tab 19 with a projection 19A thereon and a neck 18 (as seen in FIG. 1). Projection 19A is adapted to slide in aperture 27A of drawer slide 2. As shown in FIG. 4, the right hand side of the neck 18 has a ridge 18A which makes it semi-rigid. The left hand remote end of neck 18 is more resilient. Butterfly catch 20 is fixedly mounted to drawer slide 2 by means of a rivet 14. It is equipped with an aperture 22 and a pair of wings 21.

Figure 5:
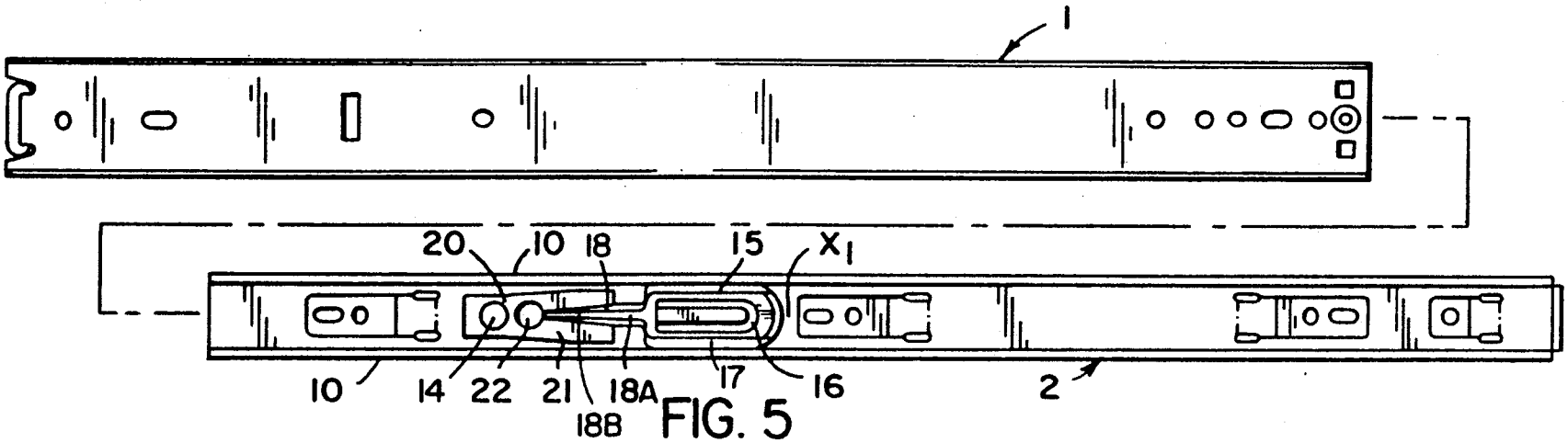
FIG. 5 shows the drawer slide completely removed from the cabinet slide; the locking mechanism being in the unlocked position.

In FIG. 5, one notes that the drawer slide 2 has been removed from the outer cabinet channel 1 exposing the release lever 15 and the butterfly catch 20. The lock-/release mechanism is in the locked position wherein the wings 21 have moved inwardly from the side flanges 10 of the inner drawer slide 2.

FIG. 5 shows the two portions 20 and 15 in same relative configuration to one another as in FIG. 4.

Figure 6:
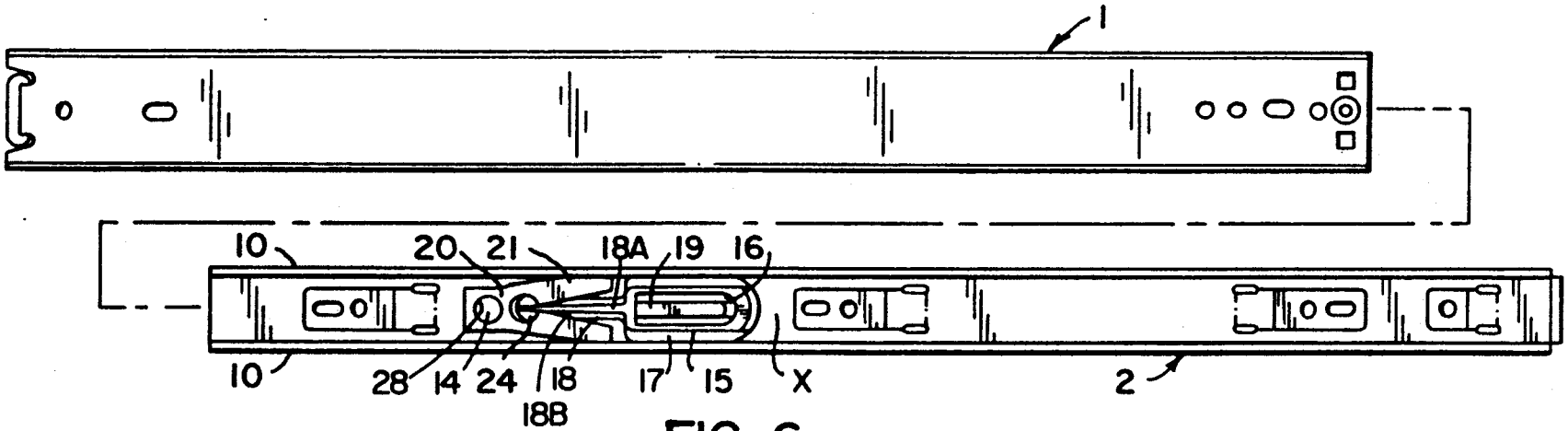
FIG. 6 is similar to FIG. 5 but the locking mechanism is in a locked position.

In FIG. 6, by way of example of the mechanism, lever 15 by means of thumb aperture 16, has been moved back towards the butterfly catch 20, such that projections 24 extend through aperture 22. This permits resilient wings 21 to again take their normally outwardly biased position against flanges 10. Thus the configuration shown in FIG. 6 has the release lever 15 and butterfly catch 20 in the same position, relative to one another, within the inner drawer slide as the position partially shown in FIG. 3.

Figure 7A:
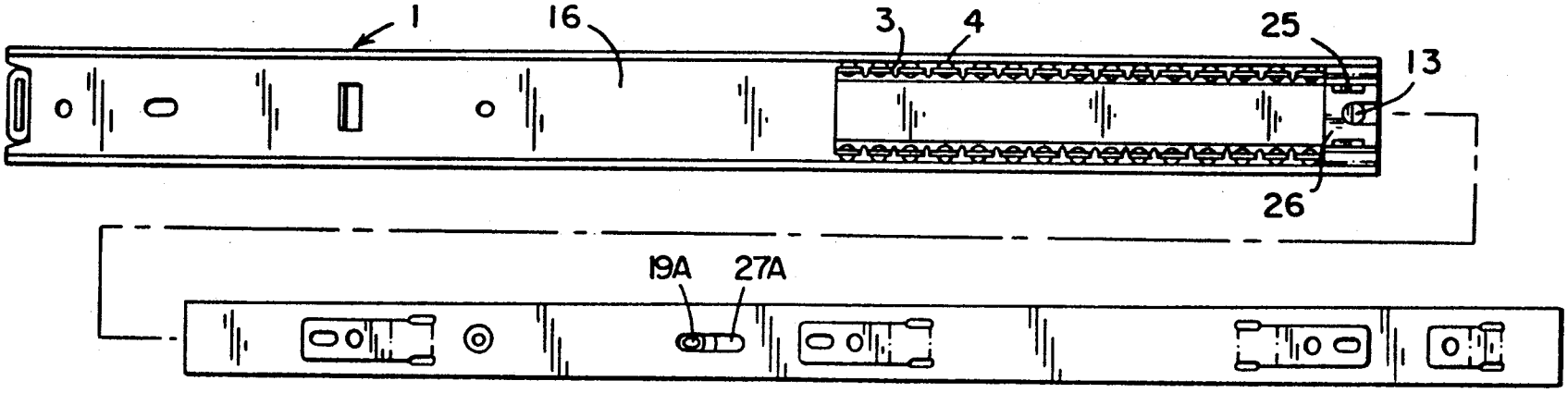
FIG. 7A shows an exploded view of a drawer slide assembly locking mechanism removed from the cabinet slide with a view of the inside portion of the cabinet slide.

FIG. 7A is similar to FIGS. 5 and 6, except that the inner side of large channel 1, and the outer side of inner channel 2 is shown. One sees that in the separated position, the ball retainer 3 holding the balls 4 is moved to the extreme right side of channel 1. It is, however, prevented by moving to the right by means of the stop block 26, which has outer ridges 30 which abut the ends of flanges 9 of large outer channel 1.

Figure 7B:
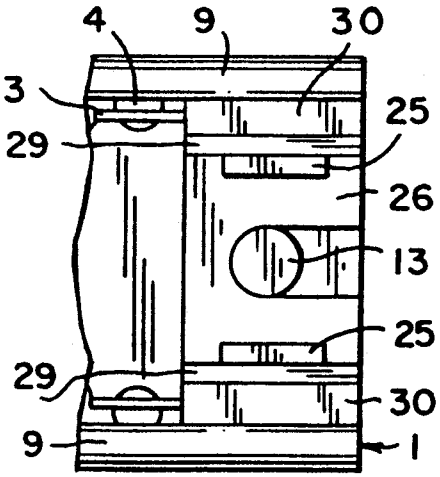
FIG. 7B is an enlarged view of the right (front) end of the inside surface of the cabinet slide.

Stop block 26 is more clearly seen in FIG. 7B. One notes that stop block 26 is fixedly attached to the end of cabinet slide 1 by means of a rivet 13. The stop block 26 has two grooves 29 which allow the inner channel flanges 10 to slide over the stop block when the lock mechanism is in the unlocked position. Stop block projections 25, in the locked position, abut the tips of wings 21 of the butterfly catch 20.

Figure 8:
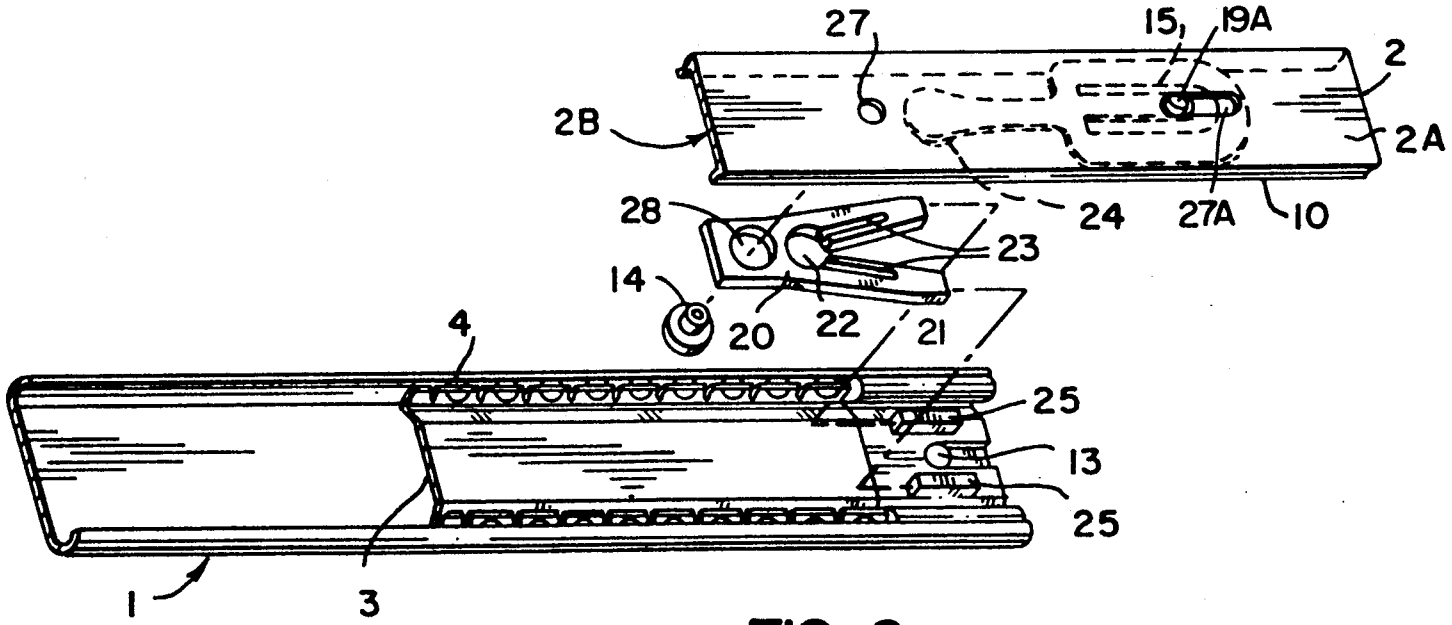
FIG. 8 is an exploded view of the lock/release mechanism.

FIG. 8 shows an exploded view of the lock/release mechanism wherein the release lever 15 is fitted within the flanges 10 and slides along the web of drawer slide 2. It abuts inner surface 2B. Butterfly catch 20 is also mounted on surface 2B by means of a rivet 14 through aperture 28 of butterfly catch 20 and aperture 27 of drawer slide 2. In the normal position wings 21 extend outwardly and rest adjacent the flanges 10. A groove 23 is located within each of the wings 21 of butterfly catch 20. The grooves 23 diverge outwardly from aperture 22.

Projections 24, located on release lever 15, are adapted to extend either through aperture 22 or within grooves 23, depending upon whether the lock release mechanism is in the locked or open position. When inner channel 2 is fitted in ball retainer 3, which is nested in outer cabinet channel 1, the tips of wings 21, in the normal locked position, contact stop block projections 25 and therefore, lock the inner drawer channel 2 within the cabinet slide 1 preventing the former from being removed.

In operation when release lever 15 is moved by means of thumb aperture 16, away from butterfly catch 20, the projections 24 leave aperture 22 and are guided along grooves 23 of wings 21. Because the projections move along the mid-line of the web 2B, they pull resilient wings 21 inwardly such that the two wings 21 are able to fit within/between projections 25, thereby allowing the inner drawer slide 2 to be removed from the outer cabinet slide, and thus the drawer can be removed from the cabinet. At the same time, projection 19A and spring lever tab 19 move from left to right in groove 27A.

Once the drawer is removed and the operator releases his hold on thumb aperture 16, the release lever tends to revert back to its locked position because of the action of spring lever tab 19 and the resiliency of wings 21 of butterfly catch 20.

When one wishes to replace the drawer in the cabinet, the lock/release mechanism is put into position as shown in FIG. 5, and then the drawer can be replaced into the cabinet. When the release mechanism 15 is moved back towards the catch 2 to place the drawer in the locked non-removable position.

What I claim as my invention is:

1. A lockable/releasable drawer slide assembly for use with a cabinet and drawers comprising:

an outer slide channel adapted to be secured to a cabinet wall;

an inner slide channel adapted to be secured to a drawer;

a ball retainer and a plurality of ball bearings disposed between said outer slide channel and said inner slide channel;

a releasable locking means adapted to either prevent said drawer from being withdrawn from said cabinet when in a first position, or to allow said drawer slide assembly to be separated, and said drawer to be removed from said cabinet, in a second position;

said releasable locking means comprising a release lever, a butterfly catch including a pair of outwardly biased wings and a stop block;

wherein in operation when said releasable/locking means is in said first position, said wings of said butterfly catch abut said stop block and when said locking means is in said second position said wings are retracted inwardly, free from contact with said stop block.

2. A lockable drawer slide assembly as claimed in claim 1 wherein said butterfly catch is fixedly attached within said inner slide channel between side flanges, and includes an aperture therein;

said outwardly biased wings are resilient, and diverge towards and abut said side flanges when in said first position;

each of said wings further including a groove therein, said groove being parallel to the longitudinal axis of each of said wings.

3. A slide assembly as claimed in claim 2 wherein said release lever is slideably mounted within said inner slide channel adjacent said butterfly catch;

said release lever comprising a pair of spaced apart projections near one end and comprising a finger aperture near the opposite end;

wherein, in operation, said projections are adapted to extend into said butterfly catch aperture when in said first position, and extend into said grooves in said wings when in said second position.

4. A slide assembly as claimed in claim 3 wherein said release lever further comprises an elongate spring tab lever within said finger aperture;

said spring tab lever being resilient and having a projection on its remote end;

said projection adapted for sliding movement within an aperture in the web of said inner slide channel.

5. A lock/release device for use with drawer slides, as claimed in claim 4, wherein in operation said spring lever tab is resilient and said release lever is urged to return to the locked position in order to ensure that said inner slide is not returned to said outer slide in the unlocked position.

6. A slide assembly as claimed in claim 1 wherein said stop block is fixedly mounted between side flanges of said outer slide at one end thereof, and comprises a pair of elongate projections;

said projections being spaced apart and parallel to the longitudinal axis of said cabinet slide;

said projections being spaced inside side flanges of said outer slide and adapted to fit within flanges of said inner slide.

7. A lockable/releaseable drawer slide assembly for use with a cabinet and drawers comprising:

an outer slide channel adapted to be secured to a cabinet wall;

an inner slide channel adapted to be secured to a drawer;

a ball retainer and a plurality of ball bearings disposed between said outer slide channel and said inner slide channel;

a releasable locking means adapted to either prevent said drawer from being withdrawn from said cabinet when in a first position, or to allow said drawer slide assembly to be separated and said drawer to be removed from said cabinet, in a second position;

said releasable locking means comprising a release lever, slidably mounted within said inner slide channel and including a pair of spaced apart projections near one end and a finger aperture near the opposite end;

a butter fly catch including a pair of outwardly biased resilient wings, each of said wings including a groove therein wherein said groove is parallel to the longitudinal axis of each of said wings; said catch being fixedly attached within said inner slide channel between side flanges adjacent said release lever and further including an aperture therein; and a stop block fixedly mounted between side flanges of said outer slide channel at one end thereof, and comprising a pair of elongate projections; said projections being spaced apart and parallel to the longitudinal axis of said outer slide channel and being spaced inside side flanges of said outer slide and adapted to fit within flanges of said inner slide;

wherein, when in operation, said inner slide channel is extended from said outer slide channel and said releasable locking means is in said first position, ends of said wings abut said stop block projections and said projections on said release lever extend into said catch aperture; and when said release lever is moved away from said butterfly catch, said projections of said release lever extend into said grooves on said wings thereby biasing said wings inwardly towards the center of said inner channel such that said ends of said wings lie between said stop block projections in said second position, thereby allowing said inner slide channel to be removed from said outer slide channel.

* * * * *